US012751503B2

(12) United States Patent
Jiang

(10) Patent No.: US 12,751,503 B2
(45) Date of Patent: Oct. 6, 2026

(54) BRASSIERE HAVING SEAMLESS ADHESIVE BONDING AND STRUCTURAL STITCHING

(71) Applicant: Shenzhen Lute Jiacheng Supply Chain Management Co., Ltd., Shenzhen (CN)

(72) Inventor: Na Jiang, Shenzhen (CN)

(73) Assignee: Shenzhen Lute Jiacheng Supply Chain Management Co., Ltd., Shenzhen (CN)

( * ) Notice: Subject to any disclaimer, the term of this patent is extended or adjusted under 35 U.S.C. 154(b) by 0 days.

(21) Appl. No.: 19/243,723

(22) Filed: Jun. 20, 2025

(65) Prior Publication Data

US 2025/0311791 A1 Oct. 9, 2025

(30) Foreign Application Priority Data

Jun. 13, 2025 (CN) ..... 202521223295.9

(51) Int. Cl.
*A41C 3/00* (2006.01)

(52) U.S. Cl.
CPC ..... *A41C 3/0007* (2013.01)

(58) Field of Classification Search
CPC ..... A41C 3/007
USPC ..... 450/8, 41
See application file for complete search history.

(56) References Cited

U.S. PATENT DOCUMENTS 2,586,529 A * 2/1952 Gluckin ..... A41C 3/0007 450/48
2,594,248 A * 4/1952 Thompson ..... A41C 3/00 450/53
3,075,530 A * 1/1963 Smith ..... A41C 3/0007 450/86
3,234,946 A * 2/1966 Glogover ..... A41C 3/04 450/65
3,449,765 A * 6/1969 Beard ..... A41B 9/06 112/419
5,070,542 A * 12/1991 LaVelle ..... A41D 27/24 2/113
6,015,331 A * 1/2000 Loakim ..... A41C 3/04 450/37
6,264,530 B1 * 7/2001 Cosentino ..... A41C 3/12 450/60
6,425,800 B1 * 7/2002 Huang ..... A41C 3/0007 450/41
6,572,437 B1 * 6/2003 Waitz ..... A41C 3/00 450/1

(Continued)

FOREIGN PATENT DOCUMENTS

DE 9217736 U1 * 7/1994 ..... A41C 3/0007
JP H07133503 A * 5/1995
JP 11350208 A * 12/1999

*Primary Examiner* — Grace Huang

(57) ABSTRACT

A brassiere includes a breast-covering portion having first and second breast-covering layers bonded by a first adhesive, and a torso-covering portion having first and second torso-covering layers bonded by a second adhesive. The breast-covering portion covers a wearer's breasts, and the torso-covering portion surrounds the wearer's torso below the breasts. The breast-covering portion and the torso-covering portion are joined at a junction by stitching corresponding to a position of a lower edge of the breasts when worn.

17 Claims, 3 Drawing Sheets

(56) References Cited

U.S. PATENT DOCUMENTS

| | | | | |
|---|---|---|---|---|
| 6,779,367 | B2 * | 8/2004 | Mitchell | A41C 3/0014 66/196 |
| 6,966,815 | B2 * | 11/2005 | Weinerth | A41C 3/10 450/39 |
| 7,513,817 | B2 * | 4/2009 | Cheng | A41D 27/24 2/274 |
| 7,604,526 | B2 * | 10/2009 | Liu | A41C 3/122 450/39 |
| 7,614,256 | B2 * | 11/2009 | Mitchell | D04B 1/102 66/179 |
| 7,959,487 | B2 * | 6/2011 | Simpson | A41C 3/12 450/39 |
| 8,066,546 | B2 * | 11/2011 | Simpson | A41D 27/24 450/74 |
| 8,556,677 | B2 * | 10/2013 | Allen | A41C 3/00 450/39 |
| 11,839,242 | B2 * | 12/2023 | Almog | A41C 3/144 |
| 11,926,937 | B2 * | 3/2024 | Blythe | D04B 1/24 |
| 11,969,029 | B2 * | 4/2024 | Liu | A41C 3/12 |
| 12,004,576 | B2 * | 6/2024 | Todaro | A41C 3/144 |
| 12,022,891 | B2 * | 7/2024 | Kallile | A41C 3/12 |
| 2005/0221718 | A1 * | 10/2005 | Falla | A41C 3/0021 450/66 |
| 2008/0051005 | A1 * | 2/2008 | Huang | A41C 3/0014 450/92 |
| 2012/0330093 | A1 * | 12/2012 | Odermatt | D04B 21/12 83/13 |
| 2022/0007748 | A1 * | 1/2022 | Mastrella | A41C 3/12 |
| 2022/0248775 | A1 * | 8/2022 | Todaro | A41C 3/0007 |
| 2024/0225139 | A1 * | 7/2024 | Qin | A41C 3/04 |
| 2024/0344250 | A1 * | 10/2024 | Soylu | D04B 21/02 |
| 2025/0107578 | A1 * | 4/2025 | Brucker | A41C 3/0014 |

* cited by examiner

BRASSIERE HAVING SEAMLESS ADHESIVE BONDING AND STRUCTURAL STITCHING

CROSS-REFERENCE TO RELATED APPLICATIONS

The present application claims priority to Chinese Patent Application No. 202521223295.9, filed on Jun. 13, 2025, the entire contents of which are incorporated herein by reference.

TECHNICAL FIELD

The present application relates to the technical field of maternal and baby products, particularly to a brassiere.

BACKGROUND

As a new type of intimate apparel that has attracted considerable attention in recent years, adhesive-bonded wireless brassieres have gained widespread popularity for their lightweight design, wire-free structure, and comfortable wearing experience. However, several technical bottlenecks still need to be addressed in practical applications.

First, due to the lack of traditional underwire's rigid support structure, adhesive-bonded wireless brassieres mainly rely on multi-layer material bonding for support. This design often results in insufficient lifting capacity, especially for fuller-busted users, leading to issues like slippage, sagging, or inadequate support that negatively impact the wearing experience. Second, while these brassieres emphasize comfort in cup design, the lack of precise adaptation to different breast shapes frequently causes problems-insufficient cup depth may lead to breast compression or spillage, while excessive depth results in poor support or gap formation. The adaptability to various breast shapes still requires improvement. Moreover, adhesive-bonded wireless brassieres typically need to combine different materials to meet localized functional requirements. For example, the breast-covering portion requires both support and breathability, while the torso-covering portion demands higher elasticity and better fit. However, this multi-material assembly approach often leads to reduced comfort at bonding areas or insufficient adhesive strength due to inadequate bonding processes during production, ultimately affecting the brassiere's overall performance and service life.

Therefore, achieving stronger support, better breast-shape adaptation, and optimized material assembly in adhesive-bonded wireless brassiere design has become a critical technical challenge. This requires not only innovations in material selection and structural design but also breakthroughs in bonding processes and manufacturing technologies to meet consumers' comprehensive demands for comfort, functionality and durability.

SUMMARY

In view of the deficiencies in existing technologies, the present application provides a brassiere that can address insufficient breast support, inadequate breast-shape conformity, poor fit, and inability to meet users' diverse fabric requirements.

To solve the aforementioned technical problems, one technical solution adopted in the embodiments of this application is to provide a brassiere comprising: a breast-covering portion configured to cover the wearer's breasts when worn, the breast-covering portion comprising at least a first breast-covering layer and a second breast-covering layer bonded together by adhesive in at least partial regions; and a torso-covering portion configured to surround the wearer's torso below the breasts when worn, the torso-covering portion being connected to the breast-covering portion at a junction via stitching corresponding to the position of the breast lower edge when worn, the torso-covering portion comprising at least a first torso-covering layer and a second torso-covering layer bonded together by adhesive in at least partial regions.

In one embodiment, the brassiere further comprises a breast support strip disposed along the junction and stitched to both the breast-covering and torso-covering portions via the stitching.

In one embodiment, the breast support strip comprises terry cloth.

In one embodiment, the breast support strip is positioned closer to the wearer's body than the breast-covering portion.

In one embodiment, the stitching comprises first and second stitch lines spaced apart from each other.

In one embodiment, the first breast-covering layer is a fabric outer layer while the second is a molded cup layer.

In one embodiment, the first breast-covering layer covers the second layer's surface with its edges folded and adhered to the inner surface of the second layer.

In one embodiment, the first torso-covering layer is a main body layer with larger coverage area, while the second is an underband layer with higher elastic modulus to provide greater contraction force when worn.

In one embodiment, the underband layer folds around the main body layer's lower edge, adhering to both inner and outer surfaces of the lower edge region.

In one embodiment, the terry cloth is folded and stitched to the breast-covering portion and torso-covering portion to form the breast support strip at the junction.

To solve the aforementioned technical problems, another technical solution adopted in the embodiments of this application is to provide a brassiere comprising: a breast-covering portion configured to cover the wearer's breasts when worn, the breast-covering portion comprising at least a first breast-covering layer and a second breast-covering layer bonded together by adhesive in at least partial regions; a torso-covering portion configured to surround the wearer's torso below the breasts when worn, the torso-covering portion being connected to the breast-covering portion at a junction via stitching corresponding to the position of the breast lower edge when worn, the torso-covering portion comprising at least a first torso-covering layer and a second torso-covering layer bonded together by adhesive in at least partial regions; the stitching comprising first and second stitch lines spaced apart from each other; and a breast support strip disposed along the junction and stitched to both the breast-covering and torso-covering portions via the stitching.

In one embodiment, the breast support strip comprises terry cloth.

In one embodiment, the breast support strip is positioned closer to the wearer's body than the breast-covering portion.

In one embodiment, the first breast-covering layer is a fabric outer layer while the second is a molded cup layer.

In one embodiment, the first breast-covering layer covers the second layer's surface with its edges folded and adhered to the inner surface of the second layer.

In one embodiment, the first torso-covering layer is a main body layer with larger coverage area, while the second is an underband layer with higher elastic modulus to provide greater contraction force when worn.

In one embodiment, the underband layer folds around the main body layer's lower edge, adhering to both inner and outer surfaces of the lower edge region.

In one embodiment, the terry cloth is folded and stitched to the breast-covering portion and torso-covering portion to form the breast support strip at the junction.

To solve the aforementioned technical problems, another technical solution adopted in the embodiments of this application is to provide a brassiere comprising: a breast-covering portion configured to cover the wearer's breasts when worn, the breast-covering portion comprising at least a first breast-covering layer and a second breast-covering layer bonded together by adhesive in at least partial regions, the first breast-covering layer being a fabric outer layer and the second being a molded cup layer; and a torso-covering portion configured to surround the wearer's torso below the breasts when worn, the torso-covering portion being connected to the breast-covering portion at a junction via stitching corresponding to the position of the breast lower edge when worn, the torso-covering portion comprising at least a first torso-covering layer and a second torso-covering layer bonded together by adhesive in at least partial regions; the first torso-covering layer being a main body layer with larger coverage area, while the second is an underband layer with higher elastic modulus to provide greater contraction force when worn.

In one embodiment, the brassiere further comprises a breast support strip disposed along the junction and stitched to both the breast-covering and torso-covering portions via the stitching.

The embodiments of this application achieve the following technical effects by providing a brassiere comprising: a breast-covering portion configured to cover the wearer's breasts when worn, the breast-covering portion comprising at least a first breast-covering layer and a second breast-covering layer bonded together by adhesive in at least partial regions; and a torso-covering portion configured to surround the wearer's torso below the breasts when worn, the torso-covering portion being connected to the breast-covering portion at a junction via stitching corresponding to the position of the breast lower edge when worn, the torso-covering portion comprising at least a first torso-covering layer and a second torso-covering layer bonded together by adhesive in at least partial regions: (1) The adhesive bonding process between breast-covering and torso-covering portions creates seamless bonding; (2) The stitching connection at the junction enhances support at the breast lower edge and improves lifting capacity; (3) The junction connection improves conformity to breast shape and enhances fit; (4) The combination of adhesive bonding and stitching meets users' diverse requirements for fabric combinations.

BRIEF DESCRIPTION OF THE DRAWINGS

To more clearly illustrate the technical solutions of the embodiments of the present application or the prior art, a brief introduction of the drawings used in the description of the embodiments or the prior art is provided below. It is apparent that the drawings described below only illustrate some embodiments of the present application. For those skilled in the art, other drawings may be obtained based on the structures shown in these drawings without any creative effort.

The achievement of the objectives, functional features, and advantages of the present application will be described in detail in combination with the embodiments and with reference to the accompanying drawings.

DETAILED DESCRIPTION OF THE EMBODIMENTS

In the present application, the terms "arranged," "provided with," and "connected" should be understood broadly. For example, a connection may be fixed, detachable, or integrally constructed; it may be mechanical or electrical; it may be direct or indirectly connected through an intermediary, or it may refer to internal communication between two devices, components, or constituent parts. Those of ordinary skill in the art can understand the specific meanings of these terms in the context of the present application based on specific circumstances.

The terms "center," "longitudinal," "transverse," "length," "width," "thickness," "upper," "lower," "front," "rear," "left," "right," "vertical," "horizontal," "top," "bottom," "inner," "outer," "radial," and "circumferential" are used to describe orientations or positional relationships based on the orientations or positional relationships shown in the accompanying drawings. These terms are used solely for the purpose of facilitating the description of the present application and simplifying the description, and do not indicate or imply that the referenced devices or components must have a specific orientation or be constructed and operated in a specific orientation. Therefore, these terms should not be construed as limiting the present application.

Furthermore, the terms "first" and "second" are used for descriptive purposes only and should not be construed as indicating or implying relative importance or implicitly specifying the quantity of the indicated technical features. Thus, features defined by "first" or "second" may explicitly or implicitly include at least one such feature. In the description of the present application, the term "plurality" means at least two, such as two, three, etc., unless explicitly stated otherwise.

Additionally, some of the above terms may be used to indicate meanings other than orientation or positional relationships. For example, the term "upper" may, in some cases, also be used to indicate a certain dependency or connection relationship. Those of ordinary skill in the art can understand the specific meanings of these terms in the context of the present application based on specific circumstances.

Figure 1:
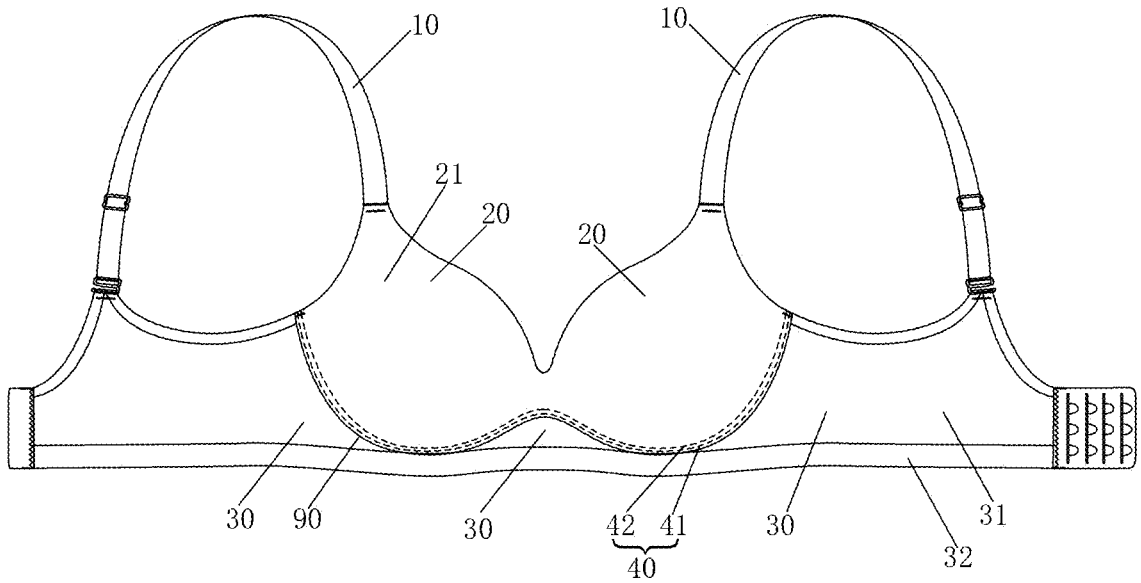
FIG. 1 is a front structural schematic view of the brassiere according to an embodiment of the present application.
Figure 2:
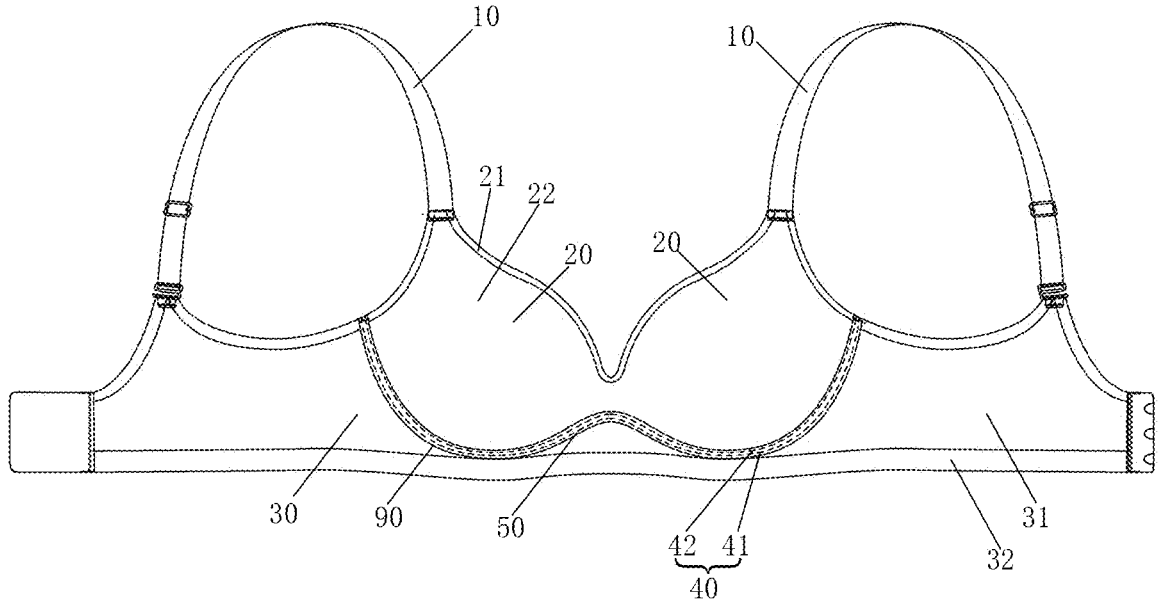
FIG. 2 is a rear structural schematic view of the brassiere according to an embodiment of the present application.
Figure 3:
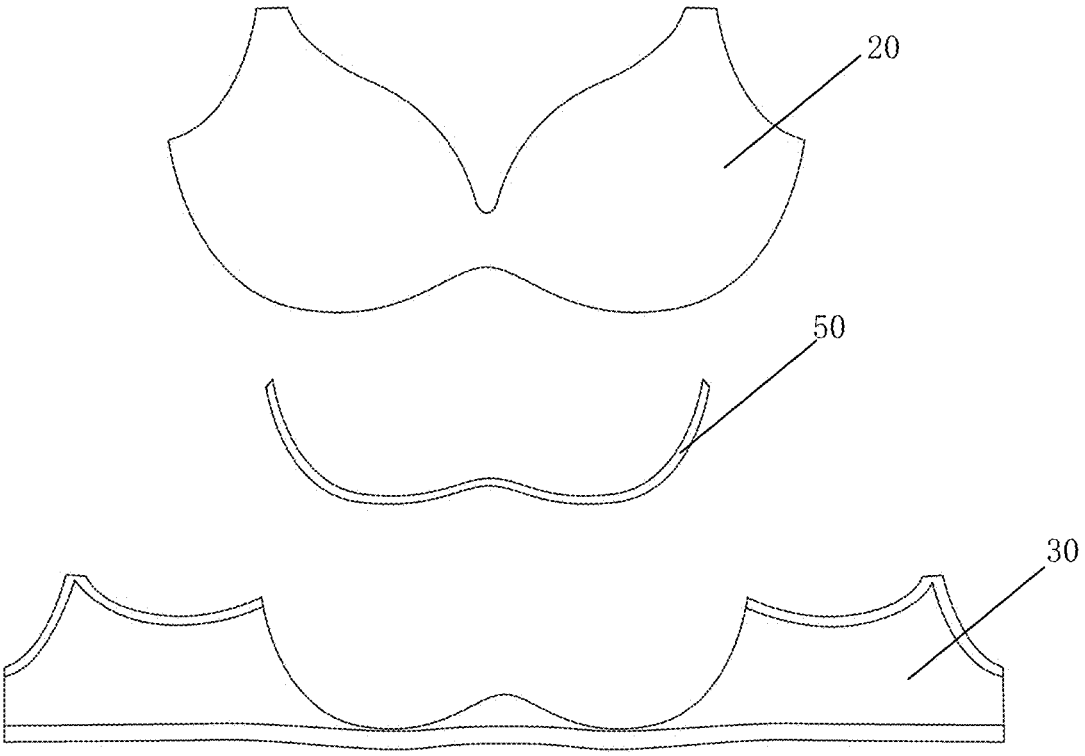
FIG. 3 is a partially exploded structural schematic view of the brassiere according to an embodiment of the present application.
Figure 4:
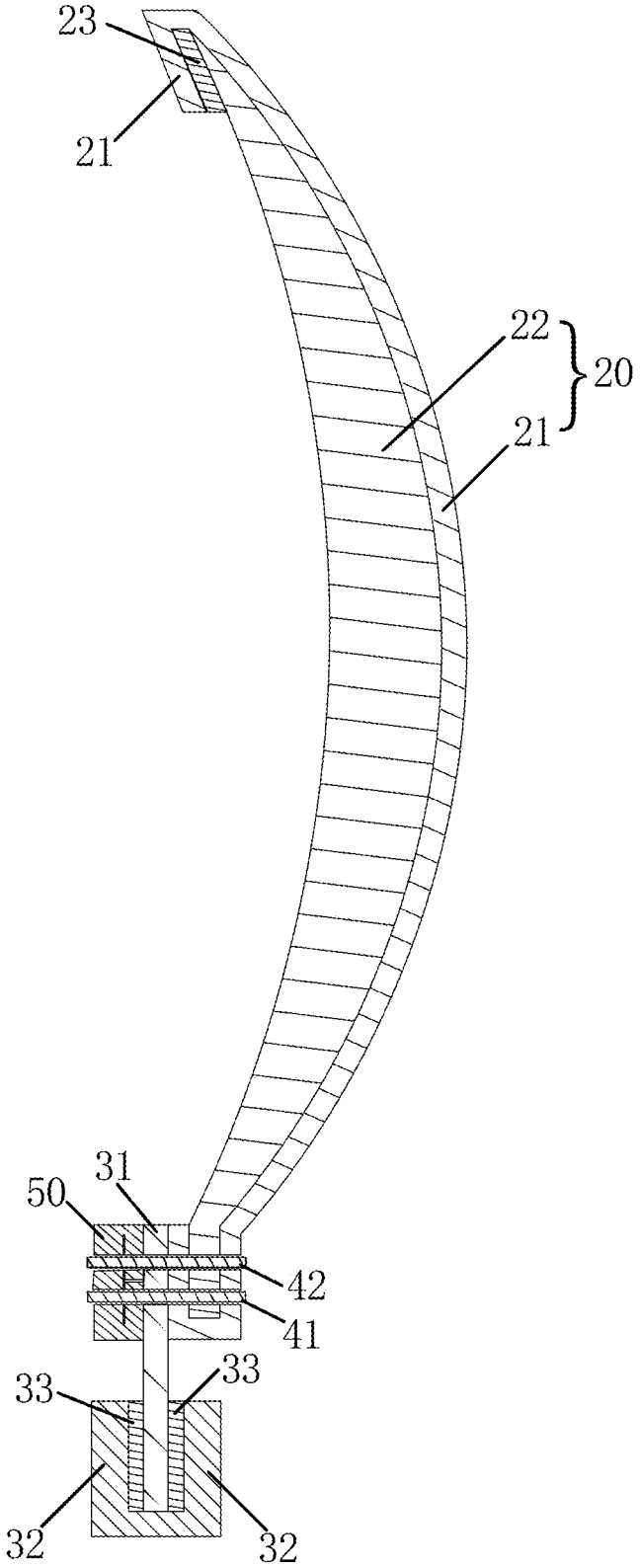
FIG. 4 is a cross-sectional structural schematic view of the brassiere according to an embodiment of the present application.

Please refer to FIGS. 1 to 4. FIG. 1 is a front structural schematic view of the brassiere according to an embodiment of the present application; FIG. 2 is a rear structural schematic view of the brassiere according to an embodiment of the present application; FIG. 3 is a partially exploded structural schematic view of the brassiere according to an embodiment of the present application; FIG. 4 is a cross-sectional structural schematic view of the brassiere according to an embodiment of the present application.

As shown in FIGS. 1, 2, 3 and 4, the brassiere according to the embodiment of the present application may include shoulder straps 10, a breast-covering portion 20, and a torso-covering portion 30.

As shown in FIGS. 1 and 2, in this embodiment, the brassiere comprises two shoulder straps 10 corresponding to the left and right shoulders of the wearer respectively, and the shoulder straps 10 are connected to the breast-covering portion 20. The main functions of the shoulder straps 10 are to provide support and stability, make the brassiere fit the body more closely, help distribute the weight of the breasts, and reduce pressure on the back and shoulders. In some embodiments, the brassiere may not include shoulder straps, such as a strapless brassiere.

As shown in FIGS. 1, 2, 3 and 4, the breast-covering portion 20 is configured to cover the wearer's breasts when worn. The breast-covering portion 20 comprises at least a first breast-covering layer 21 and a second breast-covering layer 22, with the first breast-covering layer 21 and the second breast-covering layer 22 being bonded and secured by an adhesive 23 in at least partial regions. The bonding between the first breast-covering layer 21 and the second breast-covering layer 22 may be implemented through full-layer adhesive bonding, partial bonding, or discrete dot-pattern adhesive application, which is not limited in the embodiments of the present application.

The materials of the first breast-covering layer 21 and the second breast-covering layer 22 may be identical or different. For example, the first breast-covering layer 21 may employ a soft and skin-friendly fabric, while the second breast-covering layer 22 may utilize a material with certain supportive properties, such as molded cups. Additionally, the selection of the adhesive should consider safety and comfort factors, opting for types that are non-toxic to human body and non-irritating to skin. In some embodiments, additional functional layers may be incorporated between the first breast-covering layer and the second breast-covering layer, such as breathable layers or moisture-wicking layers, to further enhance the wearing experience. These designs are all aimed at optimizing the brassiere's performance to meet diverse user requirements.

The adhesive material may employ hot melt pressure-sensitive adhesive, water-based eco-friendly adhesive, reactive polyurethane hot melt adhesive, acrylic adhesive, or polyurethane adhesive, among others. These adhesive types all exhibit excellent bonding performance and environmental characteristics, capable of meeting diverse application requirements.

The hot melt pressure-sensitive adhesive features rapid curing and strong initial tack, making it suitable for applications requiring quick bonding and high initial adhesion. The water-based eco-friendly adhesive is renowned for being environmentally friendly, non-toxic, and odorless, aligning better with modern demands for healthy living. The reactive polyurethane hot melt adhesive combines the superior elasticity of polyurethane with the rapid curing properties of hot melt adhesives, delivering reliable bonding while maintaining garment softness and comfort. Acrylic and polyurethane adhesives also possess distinct advantages. For instance, acrylic adhesive offers excellent weather resistance and water resistance, making it suitable for outdoor or humid environments, while polyurethane adhesive, known for its high strength and abrasion resistance, is more appropriate for garment areas subjected to significant tension or wear. Selecting the appropriate adhesive type can further enhance garment quality and durability, catering to varied consumer needs.

As shown in FIG. 3, the breast-covering portion 20 in this embodiment comprises a left breast-covering portion and a right breast-covering portion, which are configured as an integrated structure. In other implementations, the left and right breast-covering portions may also be separately arranged, which is not limited in the embodiments of the present application.

As shown in FIGS. 1-4, the torso-covering portion 30 is configured to surround the wearer's torso below the breasts when worn. The torso-covering portion 30 is connected to the breast-covering portion 20 at a junction 90 via stitching 40, where the junction 90 corresponds to the position of the breast lower edge when the brassiere is worn. The torso-covering portion 30 comprises at least a first torso-covering layer 31 and a second torso-covering layer 32, with the first torso-covering layer 31 and second torso-covering layer 32 being bonded and secured by adhesive 33 in at least partial regions. The stitching 40 forms an approximately W-shaped contour that matches the natural curvature of the wearer's inframammary fold.

The first torso-covering layer 31 and second torso-covering layer 32 employ different materials to achieve specific functional requirements. The first torso-covering layer 31 may utilize soft and breathable fabrics to enhance wearing comfort, while the second torso-covering layer 32 prioritizes elasticity and support to ensure optimal shaping performance during use. The adhesive 33 undergoes rigorous testing to maintain stable bonding performance after multiple washes while being non-irritating and hypoallergenic to skin. Furthermore, the W-shaped stitching design not only improves structural stability but also effectively distributes wearing pressure to prevent localized discomfort or deformation from excessive force concentration. This design also enhances the brassiere's aesthetic appeal by creating smoother body contouring and more natural visual lines.

As shown in FIGS. 2-4, in one embodiment, the brassiere further comprises a breast support strip 50 disposed along the junction 90. The breast support strip 50 is stitched to both the breast-covering portion 20 and the torso-covering portion 30 via the stitching 40. The breast support strip 50 features a generally W-shaped configuration that corresponds to the natural curvature of the wearer's inframammary fold. As illustrated in FIG. 4, the junction 90 comprises a layered structure arranged from inner to outer layers as follows: the breast support strip 50, the first torso-covering layer 31, a first portion of the first breast-covering layer 21, the second breast-covering layer 22, and a second portion of the first breast-covering layer 21, with these layers being securely joined by the stitching 40.

The breast support strip 50 may be fabricated from a highly elastic and durable material capable of providing stable support while maintaining flexibility to accommodate wearers of different body types. Its surface undergoes special treatment to achieve anti-slip properties, effectively preventing displacement or rolling of the brassiere during wear. Additionally, the design of the breast support strip 50 incorporates lightweight characteristics to avoid compromising wearing comfort through added weight. Through its secure attachment via stitching 40, the breast support strip 50 significantly enhances the overall structural integrity of the brassiere while optimizing pressure distribution, ensuring prolonged wearing comfort. This innovative design not only improves product functionality but also extends service life and increases practical value.

In one embodiment, the breast support strip 50 is made of terry cloth. The terry cloth material is soft and exhibits excellent moisture absorption, enhancing wearing comfort. With moderate thickness, it provides adequate support while preventing excessive pressure on the skin. Furthermore, the terry cloth material possesses inherent elasticity that conforms to the wearer's body contours, thereby improving overall stability and support. This design is particularly beneficial for extended wear, effectively reducing discomfort caused by friction or moisture accumulation.

In another embodiment, the terry cloth is folded and stitched to both the breast-covering portion 20 and torso-covering portion 30 to form the breast support strip 50 at junction 90. Multiple rows of stitching securely fasten the folded terry cloth, ensuring stable positioning at junction 90 without displacement. This structural configuration not only enhances the durability of the breast support strip 50 but also optimizes the brassiere's overall fit. By integrating the terry cloth with the breast-covering and torso-covering portions, the design achieves improved support without adding extra material weight, maintaining the brassiere's lightweight characteristics. Additionally, this construction method minimizes edge friction, preventing skin irritation and delivering superior wearing comfort.

In one embodiment, the breast support strip 50 is positioned closer to the wearer's body than the breast-covering portion 20. This configuration enables the breast support strip 50 to directly engage with the wearer's body, delivering more precise support. By placing the support strip on the body-facing side, it effectively distributes breast weight pressure, reducing strain on the shoulders and back. This arrangement also prevents edge rolling or displacement during use, ensuring the brassiere maintains optimal shape even after prolonged wear. Additionally, the body-contouring design enhances the brassiere's seamless appearance, making it virtually undetectable under outer garments to satisfy both aesthetic and functional requirements.

In one embodiment, the stitching 40 comprises a first stitch line 41 and a second stitch line 42 spaced apart from each other.

In one embodiment, the first breast-covering layer 21 is a fabric outer layer while the second breast-covering layer 22 is a molded cup layer.

The fabric outer layer employs soft, skin-friendly materials that provide comfortable tactile sensation and excellent breathability to maintain dryness during extended wear. The molded cup layer utilizes foam or similar materials offering superior shaping capability that conforms to breast contours for natural support. This dual-layer construction combines comfort with functionality while visually enhancing breast silhouette for a more flattering, natural appearance. Furthermore, the layered design minimizes skin friction and irritation, significantly improving wearability.

In one embodiment, the first breast-covering layer 21 covers the surface of the second breast-covering layer 22, with its edges folded and adhered to the inner surface of the second breast-covering layer 22 via adhesive 23. This design effectively enhances the structural stability of the brassiere, creating a more secure connection between the breast-covering layers while preventing delamination or displacement during prolonged use. The edge-folding treatment with adhesive bonding not only improves product durability but also optimizes wearing comfort by reducing potential discomfort caused by material friction. Additionally, this technique improves the overall smoothness of the brassiere, enabling better contour conformity for a more seamless appearance.

In one embodiment, the first torso-covering layer 31 serves as a main body layer, while the second torso-covering layer 32 functions as an underband layer. The main body layer 31 has a larger coverage area than the underband layer 32, and the underband layer 32 has a higher elastic modulus than the main body layer 31, enabling the underband layer to provide greater contraction force during wear. This design ensures better body conformity and more stable support when worn. The high elastic modulus of the underband layer allows it to quickly return to its original shape after stretching, effectively preventing the brassiere from riding up or shifting during movement. Meanwhile, the large coverage area of the main body layer ensures comprehensive wrapping, further enhancing wearing comfort and aesthetic appeal. This structural design not only meets users' functional requirements for brassieres but also accommodates different usage scenarios.

In one embodiment, the underband layer 32 is folded to enclose the lower edge of the main body layer 31, and is adhered to both the inner and outer surfaces of the lower edge region of the main body layer 31 via adhesive 33. This bonding method not only enhances the connection strength between the underband layer and main body layer, but also effectively prevents delamination caused by prolonged use or frequent washing. The adhesive has undergone rigorous testing to ensure stable performance under varying temperature and humidity conditions. Furthermore, the width of the bonding area is precisely calculated to provide sufficient bonding strength while maintaining the brassiere's overall flexibility and comfort. This design enables more uniform force distribution during wear, further improving user experience.

The embodiments of the present application provide a brassiere comprising: a breast-covering portion configured to cover the wearer's breasts when worn, the breast-covering portion comprising at least a first breast-covering layer and a second breast-covering layer bonded together by adhesive in at least partial regions; and a torso-covering portion configured to surround the wearer's torso below the breasts when worn, the torso-covering portion being connected to the breast-covering portion at a junction via stitching corresponding to the position of the breast lower edge when worn, the torso-covering portion comprising at least a first torso-covering layer and a second torso-covering layer bonded together by adhesive in at least partial regions. By employing adhesive bonding in both the breast-covering and torso-covering portions to achieve seamless integration, while connecting them at the junction through stitching, the design enhances support at the breast lower edge and improves lifting capacity. The junction connection enables the brassiere to better conform to breast contours for improved fit. The combination of adhesive bonding and stitching techniques meets users' diverse requirements for fabric combinations.

To make the objectives, technical solutions, and advantages of the present application clearer, the following further describes the present application in detail with reference to the accompanying drawings and embodiments. It should be understood that the specific embodiments described herein are merely intended to explain the present application and are not intended to limit the present application.

The above descriptions are only specific implementations of the present application. It should be noted that, for those of ordinary skill in the art, various modifications and refinements can be made without departing from the principles of the present application. These modifications and refinements should also be regarded as falling within the protection scope of the present application.

What is claimed is:

1. A brassiere comprising:

a breast-covering portion configured to cover a wearer's breasts when worn, the breast-covering portion comprising at least a first breast-covering layer and a second breast-covering layer, wherein the first breast-covering layer and the second breast-covering layer are bonded and secured by a first adhesive in at least partial regions;

a torso-covering portion configured to surround a wearer's torso below the breasts when worn, the torso-covering portion being connected to the breast-covering portion at a junction via stitching, the junction corresponding to a position of a lower edge of the breasts when the brassiere is worn, the torso-covering portion comprising at least a first torso-covering layer and a second torso-covering layer, wherein the first torso-covering layer and the second torso-covering layer are bonded and secured by a second adhesive in at least partial regions; and a breast support strip disposed along the junction, wherein the breast support strip is stitched to the breast-covering portion and the torso-covering portion via the stitching, and wherein at the junction, the breast support strip, the first torso-covering layer, a first portion of the first breast-covering layer, the second breast-covering layer, and a second portion of the first breast-covering layer are arranged in a layered structure from an inner side to an outer side of the brassiere in that order.

2. The brassiere according to claim 1, wherein the breast support strip comprises terry cloth.

3. The brassiere according to claim 2, wherein the terry cloth is folded and stitched to the breast-covering portion and the torso-covering portion to form the breast support strip at the junction.

4. The brassiere according to claim 1, wherein the breast support strip is disposed on a side of the breast-covering portion closer to a wearer's body.

5. The brassiere according to claim 1, wherein the first breast-covering layer is a fabric outer layer, and the second breast-covering layer is a molded cup layer.

6. The brassiere according to claim 5, wherein the first breast-covering layer covers a surface of the second breast-covering layer, and an edge of the first breast-covering layer is folded and extends to an inner surface of the second breast-covering layer, the edge of the first breast-covering layer is bonded to the inner surface by the first adhesive.

7. The brassiere according to claim 1, wherein the first torso-covering layer is a main body layer, and the second torso-covering layer is an underband layer, the main body layer having a larger coverage area than the underband layer, and the underband layer having a higher elastic modulus than the main body layer such that the underband layer provides greater contraction force than the main body layer when worn.

8. The brassiere according to claim 7, wherein the underband layer is folded to enclose a lower edge of the main body layer, and the underband layer is bonded to inner and outer surfaces of the lower edge region of the main body layer by the second adhesive.

9. A brassiere comprising:

a breast-covering portion configured to cover a wearer's breasts when worn, the breast-covering portion comprising at least a first breast-covering layer and a second breast-covering layer, wherein the first breast-covering layer and the second breast-covering layer are bonded and secured by a first adhesive in at least partial regions;

a torso-covering portion configured to surround a wearer's torso below the breasts when worn, the torso-covering portion being connected to the breast-covering portion at a junction via stitching, the junction corresponding to a position of a lower edge of the breasts when the brassiere is worn, the torso-covering portion comprising at least a first torso-covering layer and a second torso-covering layer, wherein the first torso-covering layer and the second torso-covering layer are bonded and secured by a second adhesive in at least partial regions, and wherein the stitching comprises a first stitch line and a second stitch line spaced apart from each other; and a breast support strip disposed along the junction, wherein the breast support strip is stitched to the breast-covering portion and the torso-covering portion via the stitching, and wherein at the junction, the breast support strip, the first torso-covering layer, a first portion of the first breast-covering layer, the second breast-covering layer, and a second portion of the first breast-covering layer are arranged in a layered structure from an inner side to an outer side of the brassiere in that order.

10. The brassiere according to claim 9, wherein the breast support strip comprises terry cloth.

11. The brassiere according to claim 10, wherein the terry cloth is folded and stitched to the breast-covering portion and the torso-covering portion to form the breast support strip at the junction.

12. The brassiere according to claim 9, wherein the breast support strip is disposed on a side of the breast-covering portion closer to a wearer's body.

13. The brassiere according to claim 9, wherein the first breast-covering layer is a fabric outer layer, and the second breast-covering layer is a molded cup layer.

14. The brassiere according to claim 13, wherein the first breast-covering layer covers a surface of the second breast-covering layer, and an edge of the first breast-covering layer is folded and extends to an inner surface of the second breast-covering layer, the edge of the first breast-covering layer is bonded to the inner surface by the first adhesive.

15. The brassiere according to claim 9, wherein the first torso-covering layer is a main body layer, and the second torso-covering layer is an underband layer, the main body layer having a larger coverage area than the underband layer, and the underband layer having a higher elastic modulus than the main body layer such that the underband layer provides greater contraction force than the main body layer when worn.

16. The brassiere according to claim 15, wherein the underband layer is folded to enclose a lower edge of the main body layer, and the underband layer is bonded to inner and outer surfaces of the lower edge of the main body layer by the second adhesive.

17. A brassiere comprising:

a breast-covering portion configured to cover a wearer's breasts when worn, the breast-covering portion comprising at least a first breast-covering layer and a second breast-covering layer, wherein the first breast-covering layer and the second breast-covering layer are bonded and secured by a first adhesive in at least partial regions, the first breast-covering layer being a fabric outer layer, and the second breast-covering layer being a molded cup layer; and a torso-covering portion configured to surround a wearer's torso below the breasts when worn, the torso-covering portion being connected to the breast-covering portion at a junction via stitching, the junction corresponding to a position of a lower edge of the breasts when the brassiere is worn, the torso-covering portion comprising at least a first torso-covering layer and a second torso-covering layer, wherein the first torso-covering layer and the second torso-covering layer are bonded and secured by a second adhesive in at least partial regions, the first torso-covering layer being a main body layer, and the second torso-covering layer being an underband layer, the main body layer having a larger coverage area than the underband layer, and the underband layer having a higher elastic modulus than the main body layer such that the underband layer provides greater contraction force than the main body layer when worn; and a breast support strip disposed along the junction, wherein the breast support strip is stitched to the breast-covering portion and the torso-covering portion via the stitching, and wherein at the junction, the breast support strip, the first torso-covering layer, a first portion of the first breast-covering layer, the second breast-covering layer, and a second portion of the first breast-covering layer are arranged in a layered structure from an inner side to an outer side of the brassiere in that order.

* * * * *